US007001245B2

(12) United States Patent
Chen

(10) Patent No.: US 7,001,245 B2
(45) Date of Patent: Feb. 21, 2006

(54) SUBSTRATE CARRIER WITH A TEXTURED MEMBRANE

(75) Inventor: Hung Chih Chen, Santa Clara, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/384,247

(22) Filed: Mar. 7, 2003

(65) Prior Publication Data

US 2004/0175951 A1 Sep. 9, 2004

(51) Int. Cl.
*B24B 49/00* (2006.01)
*B24B 51/00* (2006.01)

(52) U.S. Cl. ..... 451/8; 451/6; 451/41; 451/63; 451/288; 451/290; 451/398

(58) Field of Classification Search ..... 451/6, 451/8, 36, 41, 59, 63, 285–290, 384, 397, 451/398

See application file for complete search history.

(56) References Cited

U.S. PATENT DOCUMENTS

| | | | | |
|---|---|---|---|---|
| 4,078,175 | A * | 3/1978 | Fletcher et al. | 378/74 |
| 4,319,432 | A | 3/1982 | Day | |
| 4,918,869 | A | 4/1990 | Kita | |
| 5,193,316 | A | 3/1993 | Olmstead | |
| 5,205,082 | A | 4/1993 | Shendon et al. | |
| 5,423,716 | A | 6/1995 | Strasbaugh | |
| 5,449,316 | A | 9/1995 | Strasbaugh | |
| 5,584,746 | A | 12/1996 | Tanaka et al. | |
| 5,584,751 | A | 12/1996 | Kobayashi et al. | |
| 5,615,597 | A | 4/1997 | Schoenmeyr | |
| 5,624,299 | A | 4/1997 | Shendon | |
| 5,643,053 | A | 7/1997 | Shendon | |
| 5,643,061 | A | 7/1997 | Jackson et al. | |
| 5,759,918 | A | 6/1998 | Hoshizaki et al. | |
| 5,803,799 | A | 9/1998 | Volodarsky et al. | |
| 5,851,140 | A | 12/1998 | Barns et al. | |
| 5,879,220 | A | 3/1999 | Hasegawa et al. | |
| 5,957,751 | A | 9/1999 | Govzman et al. | |
| 5,964,653 | A | 10/1999 | Perlov et al. | |
| 5,985,094 | A | 11/1999 | Mosca | |
| 6,012,964 | A * | 1/2000 | Arai et al. | 451/5 |
| 6,080,050 | A | 6/2000 | Chen et al. | |
| 6,132,298 | A | 10/2000 | Zuniga et al. | |
| 6,146,259 | A | 11/2000 | Zuniga et al. | |
| 6,159,079 | A | 12/2000 | Zuniga et al. | |
| 6,162,116 | A | 12/2000 | Zuniga et al. | |
| 6,165,058 | A | 12/2000 | Zuniga et al. | |
| 6,183,354 | B1 | 2/2001 | Zuniga et al. | |
| 6,210,255 | B1 * | 4/2001 | Zuniga et al. | 451/41 |
| 6,450,868 | B1 | 9/2002 | Zuniga et al. | |
| 6,652,362 | B1 * | 11/2003 | Boo et al. | 451/41 |
| 2003/0157870 | A1 * | 8/2003 | Chen et al. | 451/289 |

FOREIGN PATENT DOCUMENTS

| | | |
|---|---|---|
| EP | 0 841 123 A1 | 5/1998 |
| EP | 1 029 633 A | 8/2000 |
| JP | 2243263 | 9/1990 |
| WO | WO 99/07516 | 2/1999 |
| WO | WO 00/13851 | 3/2000 |

* cited by examiner

*Primary Examiner*—Timothy V. Eley
(74) *Attorney, Agent, or Firm*—Fish & Richardson

(57) ABSTRACT

A carrier head for a chemical mechanical polishing apparatus includes a membrane with an exterior grooved surface for improved chemical mechanical polishing. The exterior grooved surface provides a path for the flow of air from the portion between the membrane and a substrate.

26 Claims, 3 Drawing Sheets

SUBSTRATE CARRIER WITH A TEXTURED MEMBRANE

BACKGROUND

The present invention relates generally to carrier heads for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore there is a need to periodically planarize the substrate surface.

Chemical mechanical polishing (CMP) is one accepted method of planarization. This planarization method typically requires that the substrate be mounted on a carrier or polishing head. During polishing, the carrier head brings the exposed surface of the substrate into contact with a rotating polishing pad. The polishing pad may be either a "standard" or a fixed-abrasive pad. A standard polishing pad has durable roughened surface, whereas a fixed-abrasive pad has abrasive particles held in a containment media. A polishing slurry, including at least one chemically-reactive agent, and abrasive particles, if a standard pad is used, is supplied to the surface of the polishing pad. The carrier head provides a controllable load on the substrate to push it against the polishing pad.

Some carrier heads include a flexible membrane with an inner surface that that encloses a chamber and an outer surface that provides a substrate mounting surface. By controlling the pressure in the chamber, the load applied to the substrate can be varied.

Another consideration in chemical mechanical polishing is the ability to detect the presence of the substrate in the carrier head. One problem that has been encountered in chemical mechanical polishing is that the attachment of the substrate to the carrier head may fail, and the substrate may detach from the carrier head. If this occurs, the operator may not be able to visually observe that the carrier head no longer carries the substrate. In this situation, a CMP apparatus will continue to operate even though the substrate is not longer being polished. This wastes time and decreases throughput. In addition, a loose substrate, i.e., one not attached to a carrier head, may be knocked about by the moving components of the CMP apparatus, potentially damaging the CMP apparatus itself or leaving debris which may damage other substrates.

SUMMARY

In one aspect, the invention is directed to a carrier head for chemical mechanical polishing of a substrate. The carrier head has a base and a flexible membrane extending beneath the base to define a pressurizable chamber. An outer surface of the flexible membrane provides a mounting surface for a substrate, and the outer surface includes a textured portion and a smooth portion surrounding the textured portion.

Implementations of the invention may include one or more of the following features. The textured portion may have at least one groove, e.g., a plurality of linear grooves that radiate outward from a central region of the mounting surface, or at least one bump, e.g., a plurality of bumps disposed in a radially symmetric pattern. Features in the textured portion may be sufficiently small that a pressure on a front face of the substrate is substantially uniform. The flexible membrane may include a central region and peripheral lip surrounding the central portion, and the textured portion may extend from within the central portion partially into the peripheral lip. The lip may be configured so that an outer region of the outer surface of the flexible membrane surrounding the central region moves away from the substrate when the chamber is pressurized. The textured portion may extend partially into the outer region, and the smooth portion may be located in the outer region.

In another aspect, the invention is directed to a chemical mechanical polishing apparatus. The apparatus includes a polishing pad and a carrier head including a base and a flexible membrane extending beneath the base to define a pressurizable chamber. A lower surface of the flexible membrane provides a mounting surface for a substrate, and the mounting surface includes a textured portion and a smooth outer portion surrounding the textured inner portion.

In another aspect, the invention is directed to a membrane for a carrier head. The membrane has an impermeable flexible and elastic membrane having an outer surface. The outer surface includes a textured inner portion and a smooth outer portion surrounding the textured inner portion.

Implementations of the invention may include one or more of the following features. The textured portion may have at least one groove, e.g., a plurality of linear grooves that radiate outward from a central region of the mounting surface, or at least one bump, e.g., a plurality of bumps disposed in a radially symmetric pattern.

In another aspect, the invention is directed to a method of chemical mechanical polishing. The method includes positioning a substrate against a mounting surface of a flexible membrane of a carrier head. The flexible membrane defines a chamber within the carrier head, and the mounting surface including a textured inner portion and a smooth peripheral portion surrounding the textured inner portion. The chamber is evacuated to form a seal between the smooth peripheral portion and the substrate.

Implementations of the invention may include one or more of the following features. The presence of the substrate may be detected. The chamber may be pressurized to inflate the membrane and cause a portion of the membrane including the smooth peripheral portion to lift off the substrate to break the seal between the smooth peripheral portion and the substrate. The textured portion may extend into the portion of the membrane that lifts of the membrane so that air can flow through the textured inner portion to be escape from between the substrate and the membrane.

In another aspect, the invention is directed to a method of chemical mechanical polishing. The method includes positioning a substrate against a mounting surface of a flexible membrane of a carrier head. The flexible membrane defines a pressurizable chamber within the carrier head, and the mounting surface includes a grooved inner portion and a smooth outer portion surrounding the textured inner portion. The substrate is placed against a polishing surface, and the chamber is pressurized to inflate the membrane with a first pressure.

Implementations of the invention may include one or more of the following features. A second pressure may be applied to an area of an inner surface of the flexible membrane with a rigid structure.

In another aspect, the invention is directed to a method of chemical mechanical polishing. In the method a substrate is positioned against a mounting surface of a flexible membrane of a carrier head. The flexible membrane defines a chamber within the carrier head, and the mounting surface including a grooved inner portion and a smooth peripheral portion. The substrate is polished, the chamber is evacuated to form a seal between the smooth peripheral portion and a substrate after polishing of the substrate, the substrate is transferred from a polishing pad to an unloading station, and the chamber is pressurized to inflate the membrane to break the seal between the substrate and the smooth peripheral portion to position the substrate onto the unloading station.

In another aspect, the invention is directed to a method of releasing air from a region formed by contact between a substrate and a flexible membrane defining a chamber. The method includes evacuating the chamber to form a seal between the substrate and the flexible membrane, and pressurizing the chamber to break the seal between the substrate and the flexible membrane so that a lip of the flexible membrane separates from the substrate and exposes one or more channels formed on the outer surface of the membrane.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

One undesirable phenomenon that can occur during the substrate loading process (when the substrate is loaded into the carrier head) is for air bubbles to become trapped between the substrate and membrane. During polishing, these bubbles create an uneven distribution of pressure on the substrate, resulting in an unintended non-uniform polishing. Moreover, the location and shape of these bubbles can change each time a new substrate is loaded into the carrier head, resulting in non-uniform polishing from substrate to substrate. However, to achieve a high yield, i.e., a low defect rate, each successive substrate should be polished under substantially similar conditions. It is therefore desirable to minimize the amount of air trapped between the membrane and the substrate.

One way to release the air trapped between the membrane and the substrate is to provide texture on the outer surface of the membrane. Air can flow between the features of the texture to escape from between the membrane and substrate.

Figure 1:
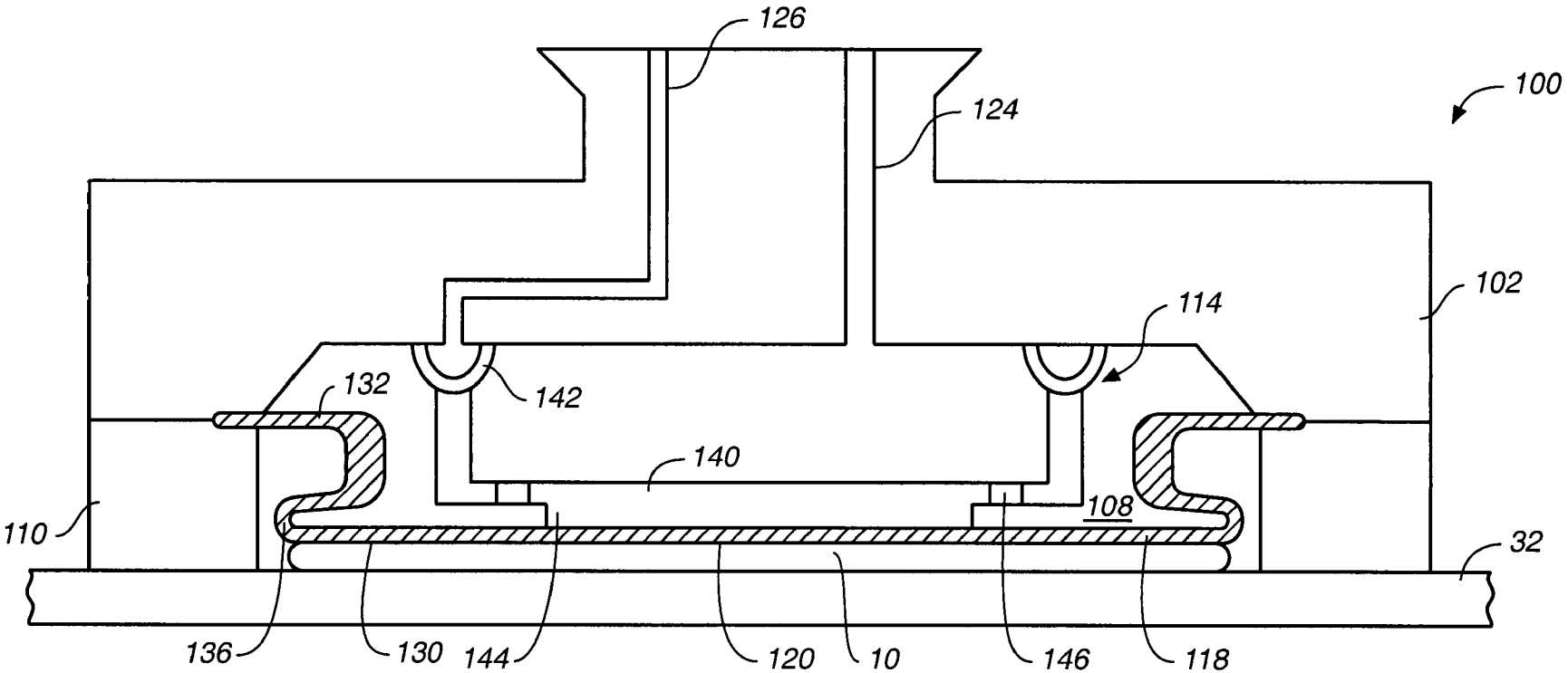
FIG. 1 is a schematic cross-sectional view of a carrier head which includes two chambers.

Referring to FIG. 1, one or more substrates 10 are held by carrier head 100 of a chemical mechanical polishing (CMP) apparatus. A suitable chemical mechanical polishing apparatus is described in U.S. Pat. No. 5,738,574, the entire disclosure of which is incorporated herein by reference.

During actual polishing, the carrier head 100 lowers the substrate into contact with a polishing pad 32, and a slurry acts as the media for chemical mechanical polishing of the substrate or wafer. The carrier head 100 loads and holds the substrate against the polishing pad and holds the substrate against the polishing pad.

The carrier head includes a housing 102 for connection to a drive shaft, a retaining ring 110, at least one flexible membrane 118, and an optional local pressure control assembly 114. The carrier head can also include other components, such as a base that is vertically movable relative to the housing, a loading chamber to control the pressure on and vertical position of the retaining ring 110, and a gimbal (which can be considered part of the base) to permit the base and retaining ring to pivot with respect to the housing. A carrier head including such features is described in U.S. Pat. No. 6,422,927, the entire disclosure of which is incorporated by reference.

The flexible membrane 118 includes a main circular central portion 130 and an edge portion 132 that is secured to the housing 102, e.g., clamped between the housing 102 and the retaining ring 110, so that the volume between the flexible membrane 118 and the housing 102 forms a chamber 108. Alternatively, the flexible membrane could be secured to a rigid support structure which is movably connected to the housing 102. Pumps or pressure regulators (not shown) can be fluidly coupled to the chamber 108, e.g., by rotary couplings, passages 124 through the housing, and/or flexible tubing to control the pressure in the chamber 108.

The outer surface of the central portion 130 of the flexible membrane 118 provides a substrate mounting surface 120 for the substrate 10. By pressurizing the chamber 108, the flexible membrane 118 can apply a uniform pressure to the back surface of the substrate 10.

The flexible membrane can also include an inflatable lip 136, as described in U.S. Pat. No. 6,210,255, the entire disclosure of which is incorporated by reference. The flexible membrane 118 can be a unitary article formed of a flexible and elastic material, such as a high strength silicone rubber.

The optional local pressure control assembly 114 can include a pressure plate 140 and an annular bladder 142. The pressure plate 140 can include apertures 146 that permit fluid flow between the portions of the chamber 108 above and below the pressure plate. Pumps or pressure regulators (not shown) can be fluidly coupled to the bladder 142, e.g., by rotary couplings, passages 126 through the housing, and/or flexible tubing, to control the pressure in the bladder 142. The pressure plate 140 includes a projection 144 that rests on the inner surface of the central portion 130 of the flexible membrane 118. By controlling the pressure in bladder 142, the load on the pressure plate 140, and thus on inner surface of the flexible membrane 118 and the substrate 10, can be controlled. By selecting the shape of the projection 144 to match an otherwise underpolished region on the substrate, the carrier head can compensate for non-uniformities in the polishing process.

During the substrate loading process, the pumps evacuate air from the chamber 108, causing the volume of the chamber to decrease and the membrane to be pulled upwardly. However, if a substrate is positioned against the mounting surface 120, the lip 136 of the membrane 118 will apply a downward pressure directly to an annular portion of the upper surface of the flexible membrane 118, creating a fluid-tight seal between the flexible membrane and the substrate. This fluid-tight seal helps vacuum-chuck the substrate to the flexible membrane 118.

Unfortunately, during the substrate loading process, some air might be trapped between the membrane and the substrate. During polishing, the air trapped between the membrane and the substrate can act to redistribute the pressure from the pressure plate 144, thereby creating undesirable and unpredictable polishing patterns. However, the texture on the outer surface of the flexible membrane 118 permits air that could otherwise be trapped in the central region of the substrate to be released when the lip is inflated. This process is explained in more detail below.

Figure 2A:
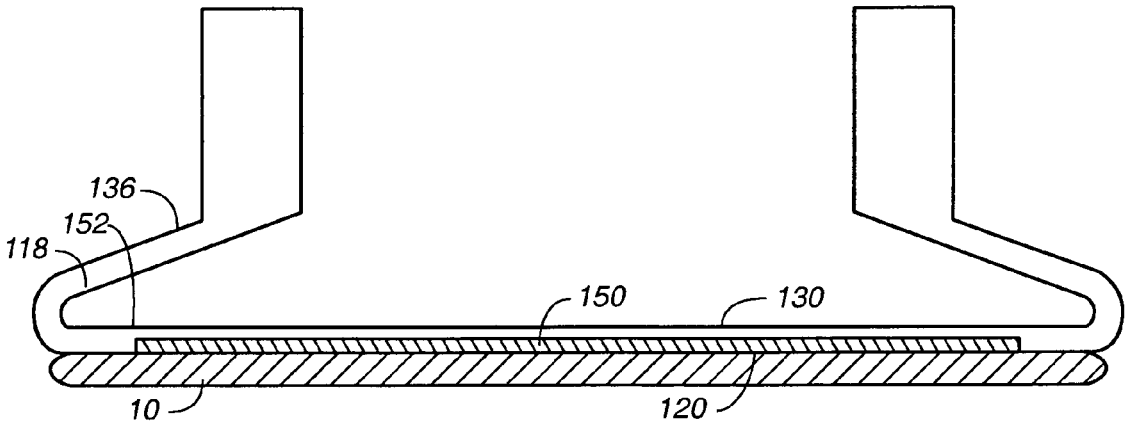
FIG. 2*a* is a schematic cross-sectional view of a flexible membrane in contact with a substrate.
Figure 2B:
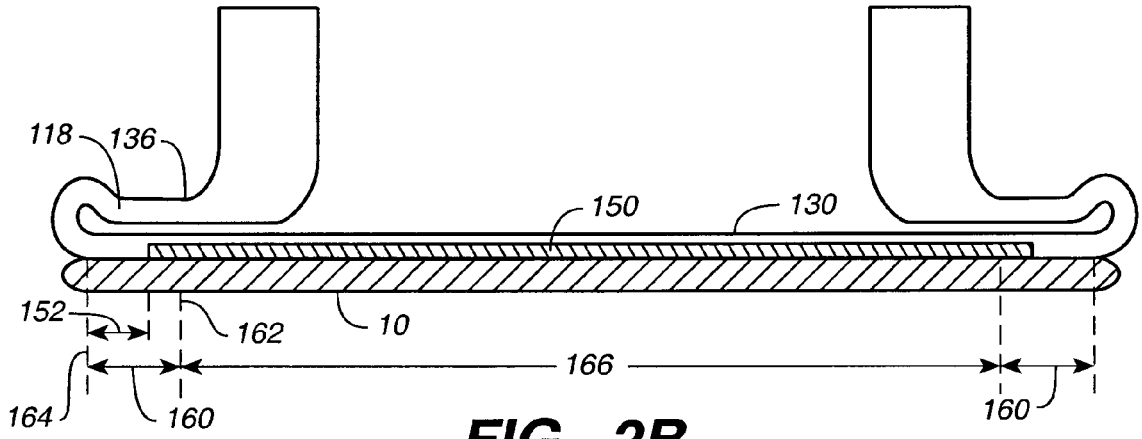
FIG. 2*b* is a schematic cross-sectional view of an evacuated flexible membrane in contact with a substrate.
Figure 2C:
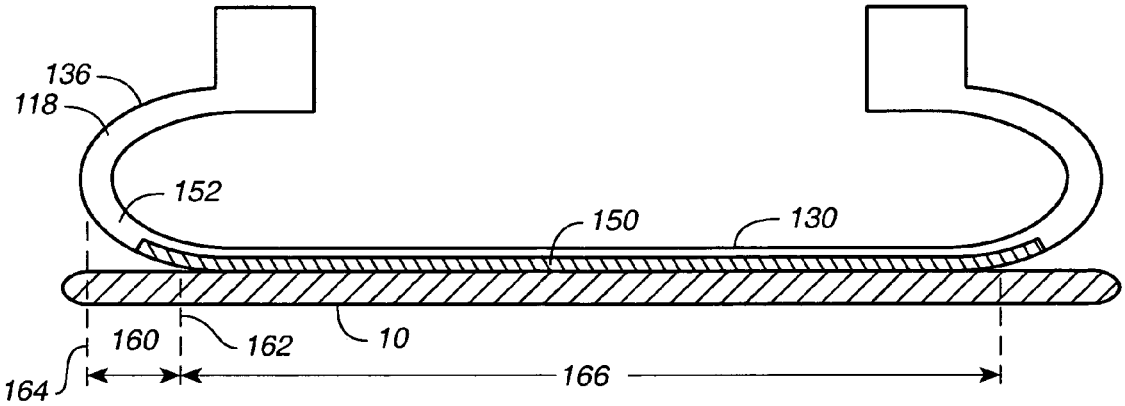
FIG. 2*c* is a schematic cross-sectional view of an inflated flexible membrane in contact with a substrate.

Referring to FIGS. 2*a*, 2*b*, and 2*c*, the outer surface of flexible membrane 118 has a textured region 150 and a smooth region 152 surrounding the textured region 150. The smooth region 152 generally corresponds to a portion of the lip 136.

When the chamber 108 is evacuated, as shown in FIG. 2*b*, both an interior region 166 of the flexible membrane—defined by the area within an inner circumference 162—and a lift-off region 160 of the flexible membrane—defined by the area between the inner circumference 162 and an outer circumference 164—is in contact with substrate 10. The outer circumference 164 is defined by the radial distance at which the membrane 118 ceases to be in contact with the substrate 10 if the chamber 108 is evacuated (as shown in FIG. 2*b*). In contrast, the inner circumference 162 is defined by the radial distance at which the membrane 118 ceases to be in contact with the substrate 10 if the chamber 108 is pressurized (as shown in FIG. 2*c*).

The textured region 150 extends partially, but not entirely, into the lift-off region 160. Thus, when the chamber 108 is evacuated, the portion of the lift-off region 160 on the lip 136 that is not textured (in the smooth region 152) forms a seal with substrate 10.

When the chamber 108 is pressurized, as shown in FIG. 2*c*, the lip 136 inflates, thereby pulling the lift-off region 160 (including the smooth portion 152) away from the substrate 10. Consequently, any air between the membrane 118 and the substrate 10 can be released through a path formed in the pattern of the textured portion 150 of the membrane 118.

The textured portion 150 extends from within the interior region 166 to a point within the lift-off region 160. The textured region 150 can cover the entire interior region 166, or only a portion of the interior region 166. The smooth region 152 should be sufficiently wide to ensure that a proper seal forms between the substrate 10 and the membrane 118 during vacuum chucking, yet sufficiently narrow to ensure that the textured region 150 is exposed when the chamber 108 is pressurized.

Figure 3:
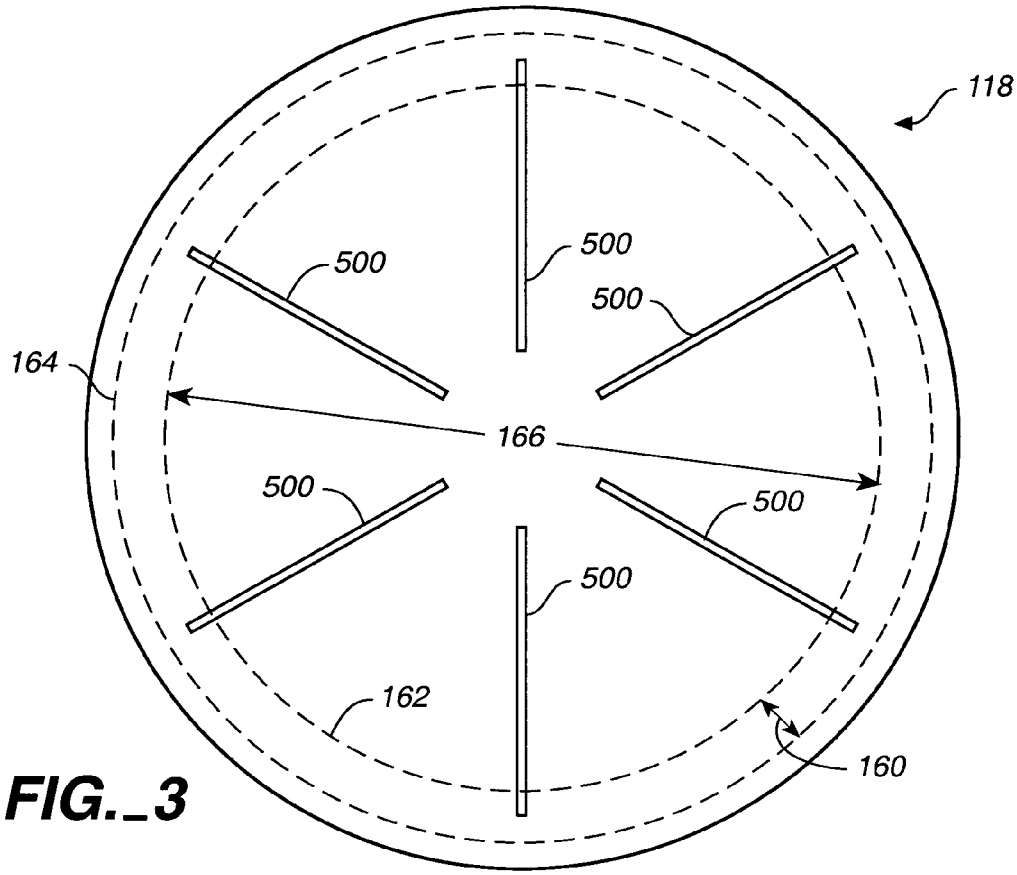
FIG. 3 is a bottom view of a flexible membrane with grooves.

As shown in FIG. 3, the texture can be provided by a set of grooves 500 that extend radially from near the center of the interior region 166 into the lift-off region 160. The grooves can be radially symmetric as shown, or they could form a cross-hatch pattern, or they could be random. Air trapped between the substrate 10 and the flexible membrane 118 in the interior region 166 can flow through the grooves to be released.

Figure 4:
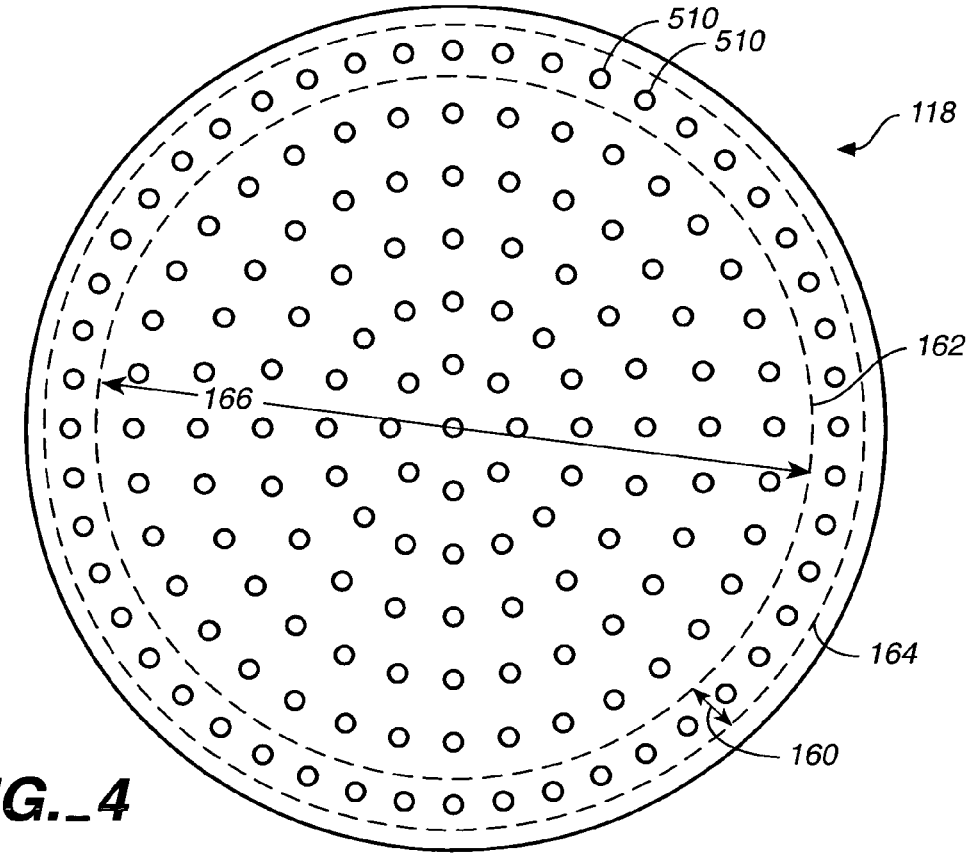
FIG. 4 is a bottom view of a flexible membrane with a ribbed surface.

As shown in FIG. 4, instead of grooves, the texture can be provided by bumps 510 that project from a generally flat surface of the membrane. The bumps can form a radially symmetric pattern. In addition, the bumps can have a uniform concentration across the textured region 150, or the bumps can have regions of different concentration. The bumps can have a uniform height, or the bumps can have different heights. Air trapped between the substrate 10 and the flexible membrane 118 in the interior region 166 can flow through the space formed between substrate and membrane by the bumps to be released.

On the one hand, the features that form the texture should be sufficiently large to permit effective fluid flow between the features so that any trapped air is released when the lip is inflated. On the other hand, the size of the features creating the texture should be small and sufficiently uniform that the resulting pressure on the front face of the wafer is substantially uniform. Both the grooves and the bumps should be larger than any microtexture that occurs accidentally during the molding process. In general, features can be about 5 to 20 mils deep. For example, the grooves can be about 0.010 inches (10 mils) deep, and the bumps can be about 0.005 inches (5 mils) high. Of course, many other patterns of grooves or bumps, and other types of texturing, are possible.

The carrier head 100 can include an actuatable valve, as described in U.S. Pat. No. 5,957,751 or in U.S. application Ser. No. 09/441,928, filed Nov. 17, 1999, the entire disclosures of which are incorporated by reference in their entirety. When the chamber is pressurized and pressure is applied between the substrate and the membrane, an air pocket may apply a pressure to the valve, thereby engaging the valve and falsely indicating absence of the substrate. Thus, another potential advantage of the textured membrane is that it may improve the reliability of the wafer sensing mechanism.

A number of embodiments of the invention have been described. Nevertheless, it will be understood that various modifications may be made without departing from the spirit and scope of the invention. For example, the textured membrane may include any surface that provides a path for the release of air trapped between the membrane and the substrate. Accordingly, other embodiments are within the scope of the following claims.

What is claimed is:

1. A method of chemical mechanical polishing, comprising:

positioning a substrate against a mounting surface of a flexible membrane of a carrier head, the flexible membrane defining a chamber within the carrier head, the mounting surface including a textured inner portion and a peripheral portion surrounding the textured inner portion, the peripheral portion including a textured portion adjacent the textured inner portion, a smooth portion surrounding the textured portion, the textured inner portion comprising texture that permits air flow along an outer surface of the membrane while the outer surface contacts the substrate, the membrane configured such that the peripheral portion contacts the substrate when the chamber is evacuated and does not contact the substrate when the chamber is pressurized; and evacuating the chamber to form a seal between the smooth portion of the peripheral portion and the substrate.

2. The method of claim 1, further comprising detecting the presence of the substrate.

3. The method of claim 1, further comprising pressurizing the chamber to inflate the membrane and causing the peripheral portion to lift off the substrate to break the seal between the smooth portion of the peripheral portion and the substrate.

4. A method of chemical mechanical polishing, comprising:

positioning a substrate against a mounting surface of a flexible membrane of a carrier head, the flexible membrane defining a pressurizable chamber within the carrier head, the mounting surface including a grooved inner portion and an outer portion surrounding the grooved inner portion, the outer portion including a grooved portion and a smooth portion surrounding the grooved portion, the grooved inner portion comprising grooves that permits air flow along an outer surface of the membrane while the outer surface contacts the substrate, the membrane configured such that the outer portion contacts the substrate when the chamber is evacuated and does not contact the substrate when the chamber is pressurized;

placing the substrate against a polishing surface; and pressurizing the chamber to inflate the membrane with a first pressure.

5. The method of claim 4, further comprising applying a second pressure to an area of an inner surface of the flexible membrane with a rigid structure.

6. A method of chemical mechanical polishing, comprising:

positioning a substrate against a mounting surface of a flexible membrane of a carrier head, the flexible membrane defining a chamber within the carrier head, the mounting surface including a grooved inward portion and a peripheral portion, the peripheral portion including a grooved portion and a smooth portion surrounding the grooved portion, the grooved inward portion comprising grooves that permits air flow along the outer surface of die membrane while the outer surface contacts a substrate, the membrane configured such that the peripheral portion contacts a substrate when the chamber is evacuated and does not contact the substrate when the chamber is pressurized;

polishing the substrate;

evacuating the chamber to form a seal between the smooth portion of the peripheral portion and the substrate after polishing of the substrate;

transferring the substrate from a polishing pad to an unloading station; and pressurizing the chamber to inflate the membrane to break the seal between the substrate and the smooth portion of the peripheral portion to position the substrate onto the unloading station.

7. A method of releasing air from a region formed by contact between a substrate and a flexible membrane defining a chamber, comprising:

evacuating the chamber to form a seal between the substrate and the flexible membrane; and pressurizing the chamber to break the seal between the substrate and the flexible membrane so that a lip of the flexible membrane separates from the substrate and exposes one or more channels formed on an outer surface of the membrane.

8. A carrier head for chemical mechanical polishing a substrate, comprising:

a base; and a flexible membrane extending beneath the base to define a pressurizable chamber, an outer surface of the flexible membrane providing a mounting surface for the substrate, the outer surface including a textured portion and a smooth portion surrounding the textured portion, the mounting surface of the membrane having a central region surrounded by an outer region, the textured portion comprising texture that permits air flow along the outer surface of the membrane while the outer surface contacts the substrate, the outer region including the smooth portion and at least part of the textured portion, wherein the membrane is configured such that the outer region contacts the substrate when the chamber is evacuated and does not contact the substrate when the chamber is pressurized.

9. The carrier head of claim 8, wherein the textured portion comprises at least one groove.

10. The carrier head of claim 9, wherein the textured portion comprises a plurality of linear grooves that radiate outward from the central region of the mounting surface.

11. The carrier head of claim 8, wherein the textured portion comprises at least one bump.

12. The carrier head of claim 8, wherein the textured portion comprises a plurality of bumps disposed in a radially symmetric pattern.

13. The carrier head of claim 8, wherein features in the textured portion are sufficiently small that a pressure on a front face of the substrate is substantially uniform.

14. The carrier head of claim 8, wherein the flexible membrane includes a peripheral lip surrounding the central region.

15. The carrier head of claim 8, wherein the textured portion includes recesses that do not extend Through the flexible membrane.

16. The carrier head of claim 8, wherein the flexible membrane includes a plurality of grooves in a cross-hatch pattern.

17. The carrier head of claim 8, wherein the flexible membrane includes a plurality of linear grooves that radiate outward from the central region of the mounting surface.

18. A chemical mechanical polishing apparatus, comprising:

a rotatable polishing pad; and a carrier head including a base and a flexible membrane extending beneath the base to define a pressurizable chamber, a lower surface of the flexible membrane providing a mounting surface for a substrate, the mounting surface including a textured portion and a smooth portion surrounding the textured portion, the textured portion comprising texture that permits air flow along an outer surface of the membrane while the outer surface contacts the substrate, the mounting surface of the membrane having a central region surrounded by an outer region, the outer region including the smooth portion and at least part of the textured portion, wherein the membrane is configured such that the outer region contacts the substrate when the chamber is evacuated and does not contact the substrate when the chamber is pressurized.

19. A membrane for a carrier head, comprising:

an impermeable flexible and elastic membrane having an outer surface, the outer surface including a textured inner portion and an outer portion surrounding the textured inner portion, the outer portion including a smooth portion and a textured portion, the textured inner portion comprising texture that permits air flow along the outer surface of the membrane while the outer surface contacts a substrate, the membrane configured such that the outer portion contacts the substrate when a chamber bounded at least in part by the membrane is evacuated and does not contact the substrate when the chamber is pressurized.

20. The membrane of claim 19, wherein the textured inner portion comprises at least one groove.

21. The membrane of claim 20, wherein the textured inner portion comprises a plurality of linear grooves that radiate outward from a central region of the mounting surface.

22. The membrane of claim 19, wherein the textured inner portion comprises at least one bump.

23. The membrane of claim 19, wherein the textured inner portion comprises a plurality of bumps disposed in a radially symmetric pattern.

24. The membrane of claim 19, wherein the textured portion includes recesses that do not extend through the flexible membrane.

25. The membrane of claim 19, wherein the flexible membrane includes a plurality of grooves in a cross-hatch pattern.

26. The membrane of claim 19, wherein the elastic membrane includes a plurality of linear grooves that radiate outward from a central region of the mounting surface.

* * * * *

UNITED STATES PATENT AND TRADEMARK OFFICE

CERTIFICATE OF CORRECTION

PATENT NO. : 7,001,245 B2
APPLICATION NO. : 10/384247
DATED : February 21, 2006
INVENTOR(S) : Hung Chih Chen It is certified that error appears in the above-identified patent and that said Letters Patent is hereby corrected as shown below:

Title page, (56) References Cited, U.S. Patent Documents; Replace:
"6,652,362 B1" with
--6,652,362 B2--

Title page, (74) Attorney, Agent, or Firm; Add:
-- P.C. -- after firm name

In Column 7, Claim 6, Line 28; Replace:
"outer surface of die membrane" with
-- outer surface of the membrane --

In Column 8, Claim 15, Line 21; Replace:
"that do not extend Through the" with
-- that do not extend through the --

Signed and Sealed this

Fourteenth Day of November, 2006

JON W. DUDAS
*Director of the United States Patent and Trademark Office*